US005344363A

United States Patent [19]

Pollock

[11] Patent Number: 5,344,363

[45] Date of Patent: Sep. 6, 1994

[54] ROOF VENT ASSEMBLY FOR GRAIN STORAGE BIN

[75] Inventor: Eugene B. Pollock, Shelby, Ill.

[73] Assignee: Grain Systems Incorporated, Assumption, Ill.

[21] Appl. No.: 782,652

[22] Filed: Oct. 25, 1991

[51] Int. Cl.[5] ..... F24F 7/02

[52] U.S. Cl. ..... 454/182; 137/527.8; 454/259; 454/359

[58] Field of Search ..... 454/9, 20, 30, 174, 454/182, 259, 347, 349, 350, 353, 359, 360; 137/527, 527.8; 34/235

[56] References Cited

U.S. PATENT DOCUMENTS

| | | | |
|---|---|---|---|
| 718,657 | 1/1903 | Renton | 454/259 X |
| 1,448,307 | 3/1923 | Loop | 454/259 X |
| 2,332,552 | 10/1943 | Belanger | 454/353 |
| 2,741,972 | 4/1956 | Pryne | 454/353 X |
| 2,754,748 | 7/1956 | Daggett | 454/359 |
| 2,784,661 | 3/1957 | Jenn | 454/353 X |
| 2,790,377 | 4/1957 | Pryne | 454/353 |
| 4,480,534 | 11/1984 | Sloan | 454/182 |
| 4,494,564 | 1/1985 | Lukacz | 137/527.8 X |
| 4,498,373 | 2/1985 | Dittmer et al. | 454/353 X |
| 4,872,398 | 10/1989 | Shen | 454/353 X |
| 5,046,408 | 9/1991 | Eugenio | 454/359 |

*Primary Examiner*—Harold Joyce

*Attorney, Agent, or Firm*—Polster, Lieder, Woodruff & Lucchesi

[57] ABSTRACT

A roof vent for a grain bin communicates air flow from within the grain bin to ambient air, especially when air is forced through the bin for the purpose of drying the grain therein. The vent includes a housing with a flap closure member in the shape of an airfoil pivotally mounted on a horizontal axis above the center of gravity of the flap member. When sufficient air pressure is developed within the bin, the force of gravity on the flap member is overcome and the flap member pivots to an open position. As air flows over and under the flap member, the airfoil shape of the flap member creates a decreased pressure over the member and a lift force causes the flap member to position itself in an open position with minimal obstruction to air flow through the vent housing providing many operational advantages. Other novel features of the roof vent include a U-shaped rod which stiffens the vent housing economically and without vent passageway obstruction; a novel plastic lip against which the novel flap closure rests and cooperates to drain away condensation, and along with inexpensive plastic pivot brackets on the flap closure alleviate freeze-up of the flap in cold weather and promote smooth, quiet operation of the vent. One embodiment of the vent is adaptable for use where air is drawn into a grain bin through the vent as well as expelled through the vent.

4 Claims, 3 Drawing Sheets

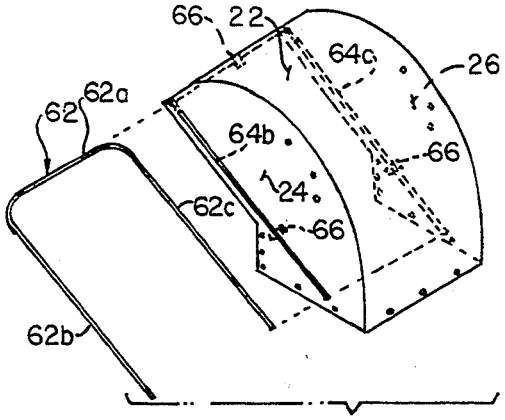
FIG.6.
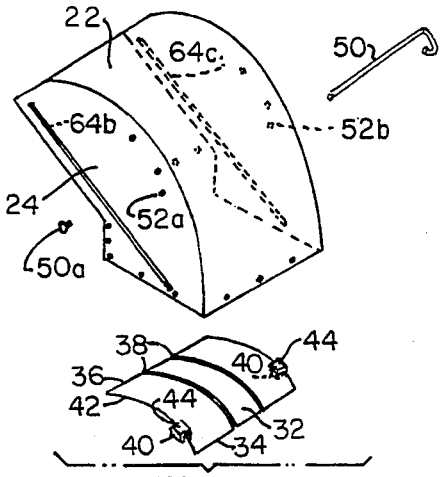
FIG.7.
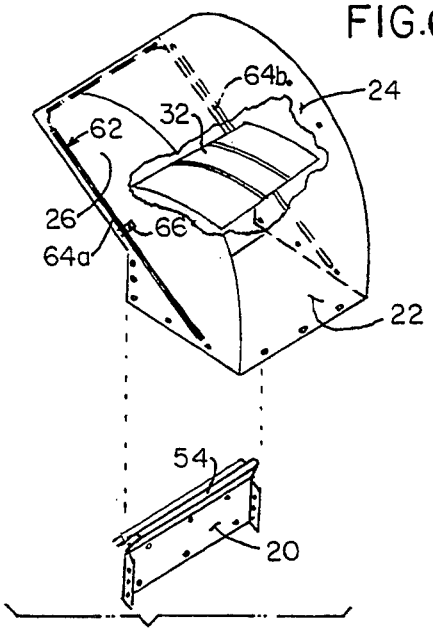
FIG.8.
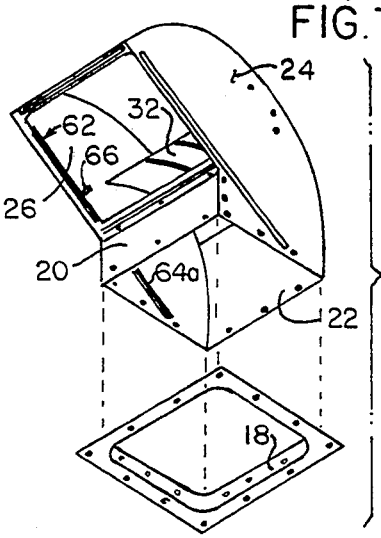
FIG.9.
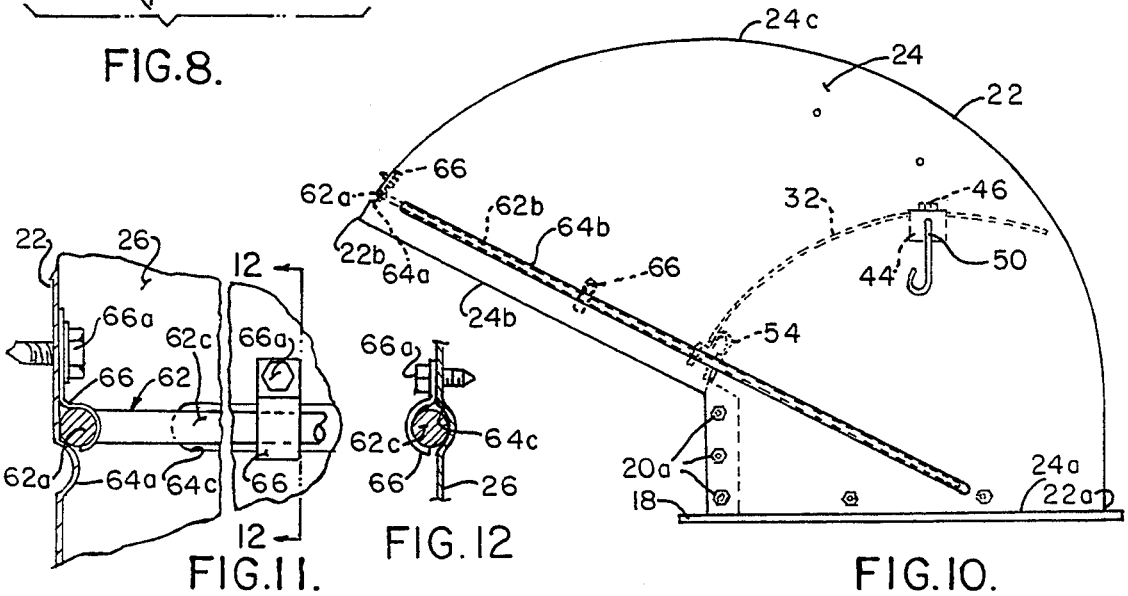
FIG.10.
FIG.11.
FIG.12

ROOF VENT ASSEMBLY FOR GRAIN STORAGE BIN

Background Of The Invention

The invention relates to roof vent assemblies for grain storage bins. Roof vent assemblies are mounted over openings in a grain bin roof to permit air flow into and/or out of the grain bin, yet prevent rain, snow, sleet, etc. from entering the bin through the opening, as well as prevent birds, animals and other solid objects from entering the bin. Roof vents may be used to equalize air pressure differentials between the interior of the bin and ambient air caused by temperature changes; however, roof vents are especially important when used on bins outfitted with grain dryer blowers.

Grain bins having grain dryer blowers include one or more fans which communicates with the interior of the bin below a perforated floor upon which the grain mass is supported. In most cases, the fan draws ambient air into the bin beneath the floor and forces the air through the floor perforations and up through the grain for the purpose of drying the grain. An air heater may be employed to more efficiently dry the grain. After the air passes through the grain it exits the bin through the roof vent. In some cases, the air flow direction is reversed, that is, air is drawn in through the roof vent, down through the grain mass, through the perforated floor and out through a low passage in the side of the bin.

It has long been recognized that a grain bin roof vent should be shaped such that the outlet opening thereof does not permit rain to enter the bin, and many roof vents have been designed with a curved top extending from and covering an upwardly directed inlet opening to a downwardly directed outlet opening. It is also known to provide either a fixed screen or wire grid in the vent passageway to prevent animals or solid objects from entering the bin. One such prior art roof vent is disclosed in the co-assigned U.S. Pat. No. 4,480,534 issued Nov. 6, 1984, the disclosure of which is incorporated herein by reference thereto. When a screen or grid is susceptible to becoming obstructed by debris, the screen has been pivotally mounted within the vent housing such that it can be swung open by the air pressure generated by the drying fan to allow for sufficient air flow out of the vent. It is also known to provide a solid flap valve member pivotally mounted along the top edge thereof in the housing to close the vent passageway by the force of gravity when the drying fan is off and no pressure differential exists between the inside of the grain bin and ambient air; and to open the passageway when the force of the air flow generated by the drying fan initially overcomes and continues to overcome the gravitational pull on the flap valve member.

One problem which is presented by the prior art constructions described above is that the obstructed pivotable screen or the solid pivotable valve member, when forced open by the air flow produced by the dryer fan, continues to present significant obstruction or resistance to air flow through the vent housing causing the dryer fan to expend significant energy in maintaining the clogged screen or solid valve member open. In order to alleviate this problem the valve member has been counterweighted to more easily open and continue in the open position. However, it has been found that during high wind conditions, such counterweighted valve members remain open after the dryer fan is stopped, thus failing to perform as intended.

Another problem exhibited by the prior art is that since virtually all parts of the vent assemblies have been constructed of sheet metal and metal rod, including the valve member hinges and the flat surface against which the flat valve member rests when in the closed position; during the winter months the valve member is very susceptible to freeze-up should moisture condense and freeze between relatively moving metal parts.

A further problem existing in the prior art constructions is that the vent sheet metal housing is reinforced or stiffened with relatively expensive bulky brackets which present further resistance to air flow through the vent housing and require unduly complicated field assembly. Also, the prior art vent housings may not be nestable for economical shipping to the construction site.

Summary Of The Invention:

It is one object of the invention to provide a roof vent assembly for a grain bin having an improved airfoil shaped valve member which initially opens when the force of gravity is overcome by the air pressure differential created by a drying fan and remains open in large measure by the lift force created by the airfoil shape of the valve member.

It is another object of the invention to provide 5improved reinforcement or stiffening of a grain bin roof vent housing which does not obstruct air flow through the housing; which is inexpensive; which allows for more economical shipping of a plurality of vent housings to the bin construction site; and which is more easily assembled at the construction site.

It is a still further object of the invention to provide a grain bin roof vent having an improved, economical, valve member and lip against which the valve member rests when closed which helps prevent accumulation of condensation and freeze-up of the valve member, reduces noise when the valve closes, and helps prevent wind from blowing the valve member open.

It is also an object of the invention to provide improved pivot brackets which are inexpensive, reduce noise, help prevent freeze-up, and provide long-lasting, smooth operation of the valve member.

Generally speaking, the grain bin roof vent of the present invention comprises a housing defining a passageway adapted to communicate air flow between the interior of a grain bin and the ambient air. A flap closure member is mounted on a pair of U-shaped plastic brackets which pivotally engage a horizontally disposed rod which passes through the housing. The flap closure member is curved and mounted to present an airfoil configuration when the air pressure differential on opposite sides of the closure member is sufficient to overcome the gravitational pull on the closure member such that the closure member is held in an open position at least in part by the lift force created by the air flow pressure differential developed above and below the airfoil closure member. When closed, the bottom edge of the closure member rests against an inexpensively formed plastic lip member having a stepped configuration to help seal the housing so that external wind will not open the closure member, yet in cooperation with the flap allows condensation to drain harmlessly out of the vent outlet. The vent housing includes two substantially flat side panels and a curved top panel extending over the side panels. The side panels are formed with inner channels into which the legs of a U-shaped rod are inserted to help stiffen the housing. The closure member pivots on U-shaped plastic brackets inexpensively cut from an elongated plastic extrusion.

These, as well as other, objects and advantages will become more apparent upon a reading of the following detailed description of the preferred embodiments in conjunction with the drawings wherein:

BRIEF DESCRIPTION OF THE DRAWINGS

FIG. 6 is an exploded perspective view of the roof vent showing the assembly of the novel housing stiffener rod according to the invention;

FIG. 7 is an exploded perspective view of the roof vent showing the assembly of the airfoil closure valve in the housing according to the invention;

FIG. 8 is an exploded perspective view showing the assembly of the novel plastic lip and front panel on the housing;

FIG. 9 is an exploded perspective view showing the assembly of a base frame on the vent housing;

FIG. 10 is an enlarged side view of the roof vent showing a more detailed view of the relationship of the housing stiffener rod to channels formed in the housing sheet metal panels;

FIG. 11 is an enlarged detail cross-sectional view of the stiffener rod at the corner of a front and side panel;

FIG. 12 is a cross-sectional detail view taken along line 12—12 of FIG. 11;

DETAILED DESCRIPTION OF THE PREFERRED EMBODIMENTS

Figure 1:
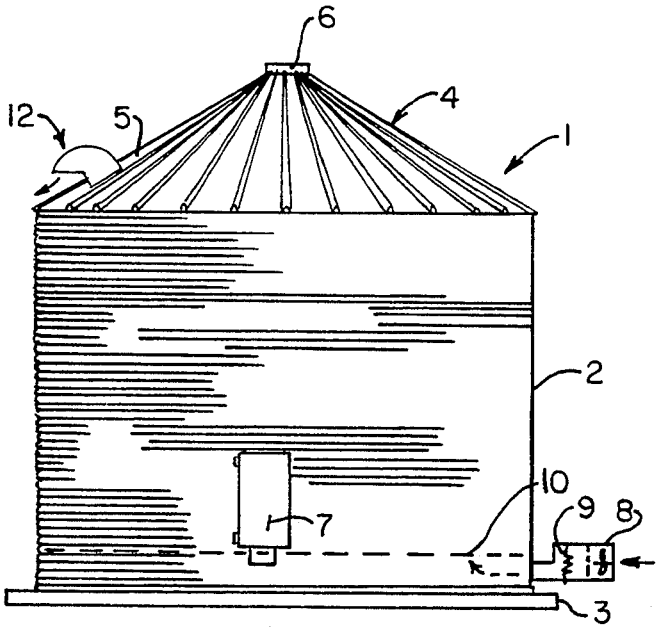
FIG. 1 is a side elevational view of a grain bin showing the general configuration and location of a grain bin roof vent according to the principles of the present invention.

With reference to the drawings, and FIG. 1 in particular, there is shown a conventional on-farm grain bin indicated in its entirety by reference numeral 1. Grain bin 1 includes a cylindrical bin body 2 formed of a multiplicity of corrugated, galvanized, sheet-metal panels mounted and bolted together on a concrete slab or foundation 3. A conical roof 4 supported on walls 2 is fabricated of a plurality of wedge shaped galvanized sheet-metal panels 5 bolted together along their edges. The upper, inner ends of panels 5 are secured to a circular peak collar 6 which constitutes an upper central opening, with a removable cover, through which grain is conveyed to load bin 1. Access door 7 provides access to the inside of bin 1 when it is empty. Adjacent ground level there is provided a blower fan 8 and heater 9 (diagrammatically shown) adapted to draw air from the outside of bin 1 into the interior of the bin, heat the air and blow the heated air beneath a perforated floor 10 upon which a mass of granular grain rests. The heated air flows upwardly through the grain, removing moisture from the grain, and exits through an opening in one or more roof panels 5 and through one or more roof vents represented generally by the numeral 12, which protect the grain from rain, animals, debris, and the like.

Figure 2:
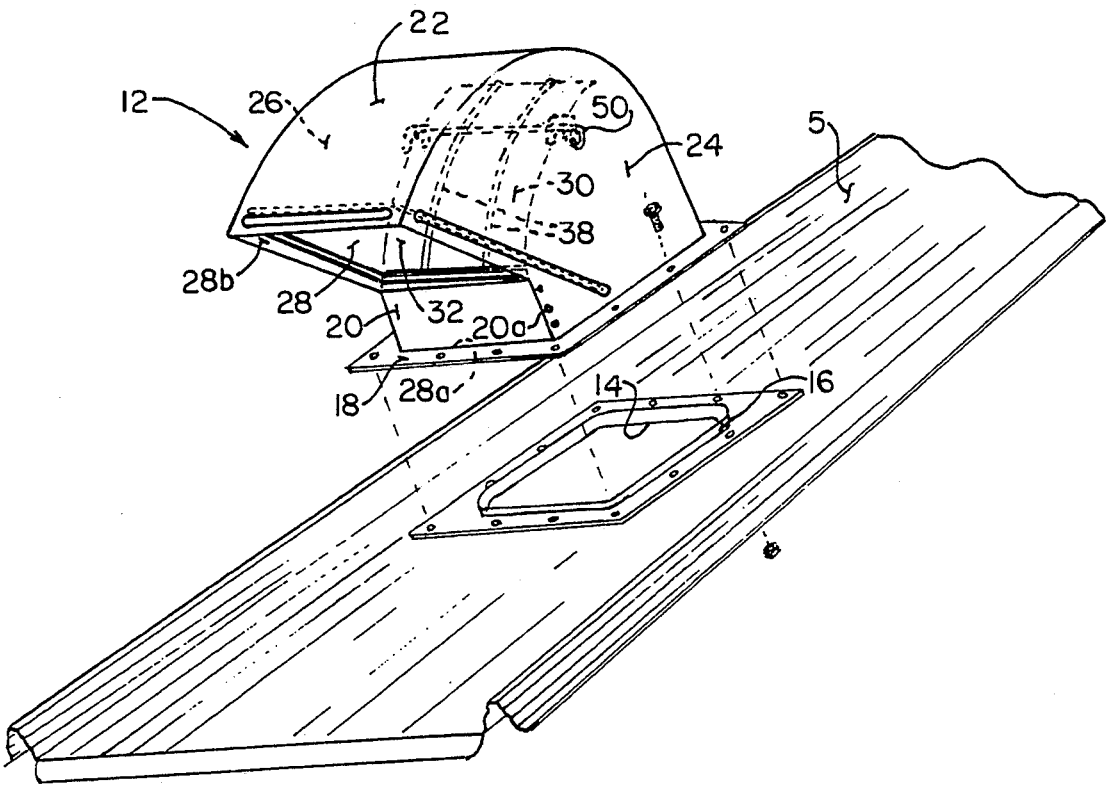
FIG. 2 is an enlarged perspective view of a roof vent for a grain bin showing the placement of the roof vent on a single sheet metal roof panel of the grain bin roof.

Referring now to FIG. 2, a portion of a roof panel 5 is shown in enlarged scale. Roof panel 5 includes an opening 14 which is surrounded by an upwardly directed weather-proofing flange 16 either integrally formed with panel 5 or sealingly attached to panel 5. Vent housing 12 includes a rectangular base frame 18 adapted to be bolted onto roof panel 5 around opening 14 and flange 16.

Roof vent housing 12, according to the present invention, is generally constructed of a short, straight, front panel 20, a long curved combination rear and top panel 22 and two substantially flat, parallel side panels 24 and 26. As shown in FIG. 10, side panels 24 and 26 each have a straight inlet edge **24*a*, a straight outlet edge 24*b* and a top edge 24*c* curved from the inlet edge to the outlet edge. Top panel 22 has an inlet edge 22*a* coplanar with inlet edges 24*a* and an outlet edge 22*b* coplanar with outlet edges 24*b*. Preferably panels 20, 22, 24, and 26 are all constructed of galvanized sheet-metal. While front panel 20 is secured to side panels 24, 26 by self tapping screws or bolts 20*a* (See FIG. 10), top panel 22 is secured to side panels 24, 26 along the contiguous edges thereof by roll forming the edges together in a well known manner. Panels 20, 22, 24, 26 combine to define a passageway 28 which is adapted to communicate air flow between the interior of grain bin 1 and ambient air exterior thereof. For purposes of clarity of description hereinafter, passageway 28 will be described as having an inlet opening 28*a* and an outlet opening 28*b*. However, it is noted that in some cases blower 8 may be operated in reverse to draw air into bin 1 through passageway 28 defined by vent housing 12** as will be described hereinafter.

In order to prevent the invasion of birds or other animals, the introduction of blowing rain or snow, or other contaminants such as air borne seeds or other debris into bin 1 through passageway 28 when air blower 8 is not in use, a flap closure valve assembly 30 is mounted within housing 12 to effectively close off passageway 28 when blower 8 is inactive and to open passageway 28 with as little obstruction as possible when blower 8 is in operation.

Figure 3:
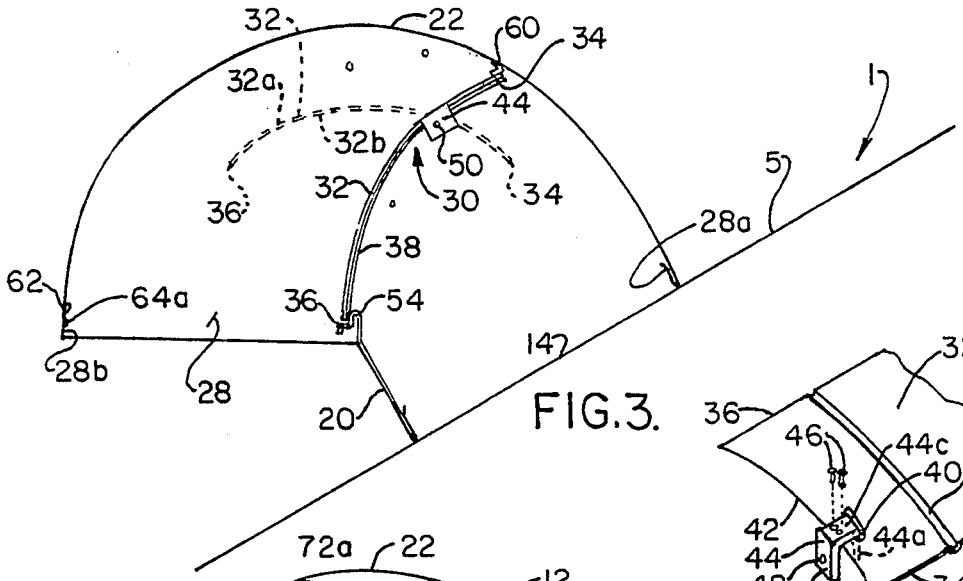
FIG. 3 is a side diagrammatic view of a roof vent for a grain bin showing the pivoted open position of the closure member in phantom line.

Flap valve closure assembly 30 includes a flap valve member 32 which is fabricated from a generally rectangular piece of galvanized, sheet-metal which has been curved or bowed from a top edge 34 (FIG. 3) to a bottom edge 36 along a substantially cylindrical arc having an axis generally located on the inlet side **28*a* of passageway 28 when member 32 is in the closed position, i.e., the midsection of member 32 bows toward outlet side 28*b* of passageway 28 when member 32 is in a somewhat vertical, closed position as shown in solid line in FIG. 3. Thus, when flap valve member 32 rotates to an open position as shown by the phantom line of FIG. 3, member 32 will present an airfoil or wing configuration as will be explained further hereinafter. As shown in FIG. 2, flap member 32 is formed with two parallel ribs of corrugation 38 which run the entire height of member 32 from top edge 34 to bottom edge 36 in order to help stiffen and strengthen member 32** from deformation and to help drain condensation as will be explained.

Figure 4:
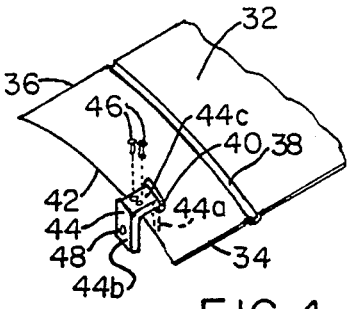
FIG. 4 is an enlarged detail view of the novel closure member pivot bracket according to the invention.

As shown in FIGS. 4 and 7, a slot 40 is cut in member 34 adjacent each lateral edge 42. The midpoints of slots 40 are located from bottom edge 36 of member 32 a distance at least sixty percent of the height of flap member 32 and no greater than eighty per cent of the height of flap member 32. For best results, the distance the midpoints of slots 40 are located from bottom edge 36, and thus the distance of the pivotal axis of member 32, is seventy-five percent of the height of member 32. Mounted at each lateral side 42 of flap valve member 32 is a generally U-shaped plastic pivot bracket 44. Each bracket 44 is positioned with an inner leg **44*a* inserted within respective slot 40 and an outer leg 44*b* located laterally outward of respective lateral edge 42. The mid-portion 44*c* of each bracket 44 is secured to flap member 32 by self-tapping screws 46. Each of legs 44*a* and 44*b* of both laterally spaced brackets 44 have a horizontal bore 48 which are all in alignment to accept therethrough horizontal pivot rod 50 (FIG. 7) which is supported in aligned holes 52*a*, 52*b* in respective housing side panels 24, 26 and secured in place by lock nut 50*a***.

As shown in FIG. 3 when flap valve member 32 is at rest; that is, when an insufficient air pressure differential exists between the interior and exterior of bin 1, flap member 32 will fall closed as shown in solid line. Gravity will pull lower edge 36 down due to the fact that the horizontal pivot axis 50 of member 32 is above the midpoint of the height of member 32 and thus the weight of member 32 below axis 50 is greater than the weight above axis 50.

Figure 5:
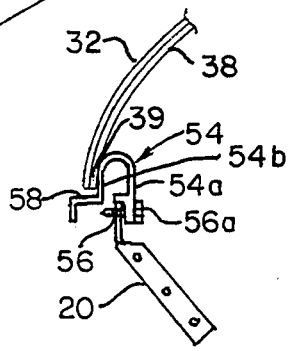
FIG. 5 is an enlarged side view of the plastic lip mounted on the housing front panel.

When in the closed position, the bottom edge 36 of flap member 32 rests against plastic lip member 54. Lip member 54 is formed of an elongated plastic extrusion of constant cross-section, the side configuration of which is best seen in FIG. 5. Lip member 54 is of generally inverted U-shaped cross-section; one leg **54*a* being secured to the top edge 56 of front housing panel 20 by self tapping screws 56*a*. The other leg 54*b* of lip member 54 is positioned to abut bottom edge 36 of flap member 32 when member 32 is in the closed position. More specifically, only the very small surface areas of the two corrugations 38 actually touch leg 54*b* thereby creating a very narrow gap 39 between the major extent of the bottom edge 36 of member 32 and lip 54. Thus, in the event condensation forms on the inside surface of member 32 it can drain between leg 54*b* of lip 54 and member 32. Beneath the portion of leg 54*b* which abuts flap member 32 is a stepped portion 58 which tilts slightly downwardly toward the exit 28*b* of vent housing 12 and extends beneath and spaced from the lower edge 36 of member 32 and acts to block wind from entering outlet 28*b* of passageway 28 between lip 54 and member 32 and helps prevent the wind from possibly separating edge 36 from lip 54 and lifting open flap valve 32. Also stepped portion 58 acts to direct condensation draining from between valve 32 and lip 54 away from lip 54 due to the downward tilt of portion 58. The novel relationship between valve member 32 and lip 54** alleviates the possibility of valve freeze-up in the winter.

As shown in FIG. 3 a top plastic lip member 60 may be provided on top panel 22, if desired, at the upper edge 34 of member 32. Top lip member 60 would be mounted on the outlet side of member 32 at the location of upper edge 34 when lower edge 36 is resting against lip member 54. It is noted, however, that top member 60 is not necessary to the successful operation of the invention. Instead upper edge 34 of member 32 can be designed to rest very close to the interior of panel 22 when the valve is at rest.

Operation of flap valve closure assembly 30 is as follows. When blower 8 is not operating the air pressure differential between the interior and exterior of bin 1 will normally be insubstantial and flap member 32, pivotally mounted on eccentrically located rod 50 will fall shut against lip 54, blocking passage of birds, animals driving rain and debris into bin 1. It is noted that since lip 54 is located about twenty degrees from the vertical line passing through pivot point 50, flap member 32 is continuously held against lip 54 by the force of gravity when blower 8 is inactive.

When blower 8 is operated to draw air into bin 1 from a bottom passage, the air pressure will build within bin 1 relative to ambient air pressure. The increased air pressure will exert a greater force on the inside lower area of flap member 32 below axis 50 than will be exerted on the inside upper area of member 32 above axis 50. As a result, the air pressure will act to rotate member 32 about axis 50 allowing air to flow both above and beneath member 32. Due to the airfoil configuration of member 32, air will be caused to flow faster over the outwardly bowed upper surface **32*a* of member 32 than will be the case under the inwardly bowed surface 32*b*. The faster moving air above airfoil member 32 will cause a relative pressure drop and an accompanying lift force on member 32. Member 32 will position itself within the airstream passing through passageway 28 in a balanced state causing the least resistance to air flow possible, that is, airfoil flap 32 will locate itself in a null position where the pull of gravity is balanced by the lift force created by the air moving above and beneath member 32. Also it is noted that the arc of flap member 32 is preferably equal to the arc of top panel 22 such that when in the open position flap member 32 may position itself parallel to top panel 22 and present the least possible resistance to air flow through vent housing 12. When fan operation ceases and air flow diminishes sufficiently, the force of gravity will again pull edge 36 of member 32 down to meet with lip 54**.

It has been found that since lip member 54 and brackets 44 are fabricated of plastic, vent 12 operates more quietly, is less prone to freeze-up between the reduced contacting points of the relatively moveable parts and will operate more smoothly and reliably over a longer period of time. Also the outer lateral legs **44*b* of bracket 44 act as built-in plastic washers between flap member 32 and side panels 24, 26**.

With reference to FIGS. 6, 10, 11 and 12, the vent housing 12 formed of sheet-metal panels 20, 22, 24, 26 is shown to be made more rigid and resistant to bending by high winds by the provision of a generally U-shaped stiffening rod 62. Rod 62 includes a midsection **62*a* and two integrally formed, parallel legs 62*b*, 62*c* extending from midsection 62*a*. Side panels 24 and 26 of vent housing 12 are each formed with a laterally outwardly extending crimp which define linear channels or troughs 64*b* and 64*c*, respectively, on the inside of passageway 28. Channels 64*b* and 64*c* are positioned to be parallel to each other and slightly above and parallel to the outlet edges of side panels 24 and 26, and extend just short of the full length of side panels 24 and 26, respectively. Top panel 22 of vent housing 12 is formed with an inwardly directed ridge 64*a* positioned parallel to the outlet edge of top panel 22 and a distance from the outlet edge just short of the distance channels 64***b*, 64*c* are located from the outlet edges of panels 24, 26. Channels 64*b* and 64*c* are sized to accept therein at least a portion of the cylindrical cross-section of rod 62. Thus, leg 62*b* of U-shaped rod 62 may be placed into channel 64*b*, and leg 62*c* may then be slightly bent and snapped into channel 64*c*. Thereafter, rod 62 is slid toward top panel 22 until midsection 62*a* abuts the inside surface of top panel 22 and is supported from downward movement by ridge 64*a*. Rod clips 66 with self tapping screws 66*a* are positioned on each panel, 22, 24, 26 to secure rod 62 in place. It has been determined that only one clip 66 per panel is necessary for proper securement of rod 62.

The improved vent housing stiffening assembly described above provides economic benefits during shipping of the assembly to the construction site as well as economy of materials. Top panel 22 may be secured to side panels 24, 26 at the factory and three such unfinished housings can be nested one within the other to reduce the volume displaced during shipping. At the construction site the three unfinished housings are unnested and a rod 62 is secured into each as shown by FIG. 6. Thereafter, flap valve 32 is positioned into the housing and pivot axis rod 50 is inserted through aligned panel holes 52*a*, 52*b* and bracket bores 48 and secured by lock nut 50*a* (FIG. 7). Front panel 20 with plastic lip 54 is then secured in place by six screws 20*a* and rectangular base frame 18 is secured onto the inlet edge of panels 20, 22, 24, 26 (FIGS. 8 and 9).

Figure 13:
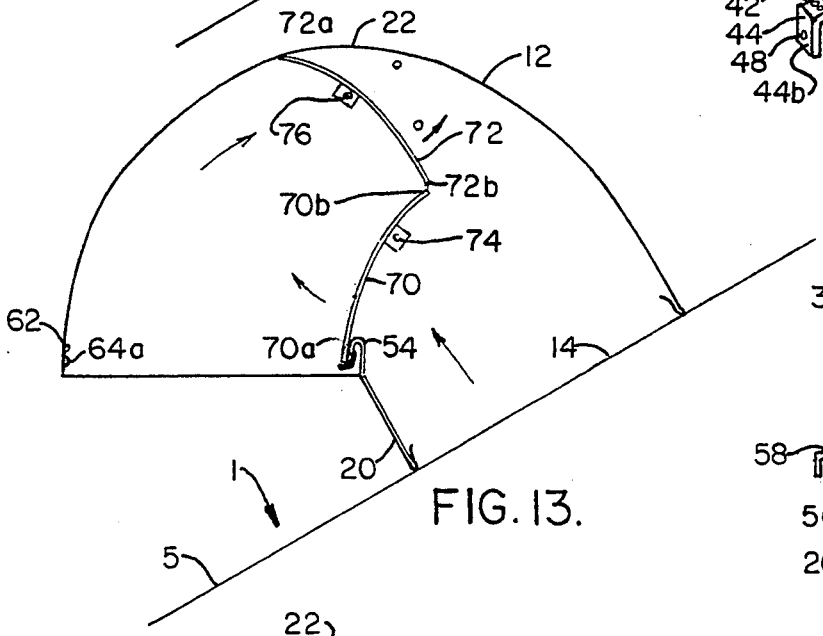
FIG. 13 is a side diagrammatic view of an alternative embodiment having airfoil shaped closure members which allow for both ingress as well as egress of forced air.

FIG. 13 shows an alternate embodiment which may be used if it is desired to also draw air into bin 1 by reversing the direction of fan 8. In this case, two airfoil shaped closure flap valves 70 and 72 are positioned to pivot on horizontal axes 74 and 76, respectively. It is noted that vent housing 12 is the same in all respects as that previously described with the sole exception being the addition of properly positioned pivot rod holes in side panels 24, 26 which can be punched at the factory or added in the field. Flap valve 70 is similar to flap valve 32 in that it pivots in the direction of the arrow such that the bottom edge 70*a* thereof swings up toward the outlet end of housing 12 in order to allow air to only escape bin 1. Flap valve 72, on the other hand, is bowed in the opposite direction from flap valve 70, and due to the abutting relationship between the upper edge 72*a* of valve 72 and housing panel 22, valve 72 can only swing in the direction of the arrows such that the lower edge 72*b* thereof swings up toward the inlet end of housing 12 to permit only ingress of air into bin 1. The lower edge 72*b* of valve 72 and the upper edge 70*b* of valve 70 are closely positioned when both valve 70 and 72 are at rest but are slightly spaced from one another so as not to interfere with the pivotal movement of either valve. Axis 76 is located preferably up from lower edge 72*b* a distance 75 percent of the height of member 72, and axis 74 is located preferably up from lower edge 70 a distance 75 percent the height of member 70. Again, when valves 70 and 72 are in their closed positions, axes 74 and 76 are offset from the vertical lines passing through points 70*a* and 72*a*, respectively, to provide positive gravity closure of the valves.

The operation of the embodiment of FIG. 13 is as follows. When fan 8 is activated to draw air into bin 1 and out of vent housing 12, the air pressure differential will act to open valve 70 and maintain it open in precisely the same manner as described hereinabove with respect to valve 32 of FIG. 3. Valve 72 will remain in the closed position when air is flowing out of housing 12 since the surface area below axis 76 exposed to the air pressure on the inlet side is much larger than the surface area above axis 76. In the event the direction of fan 8 is reversed, initially a lower pressure will exist in bin 1 relative to the ambient air. The relatively greater ambient air pressure will act to swing valve 72 open and maintain valve 70 closed. Air flowing over and under valve 72 will react on the airfoil shape of valve 72 to maintain valve 72 open in a position of least resistance to flow as described hereinabove with respect to valve 32 of FIG. 3. It can thus be seen that the advantages of the present invention can be obtained when air is drawn into a grain bin as well as when the air is expelled from the bin. It is noted that when such two-way vents are used as shown in FIG. 13, the total number of vents on the bin should be increased or the size of the vent housing should be enlarged to provide sufficient unhampered air flow.

Figure 14:
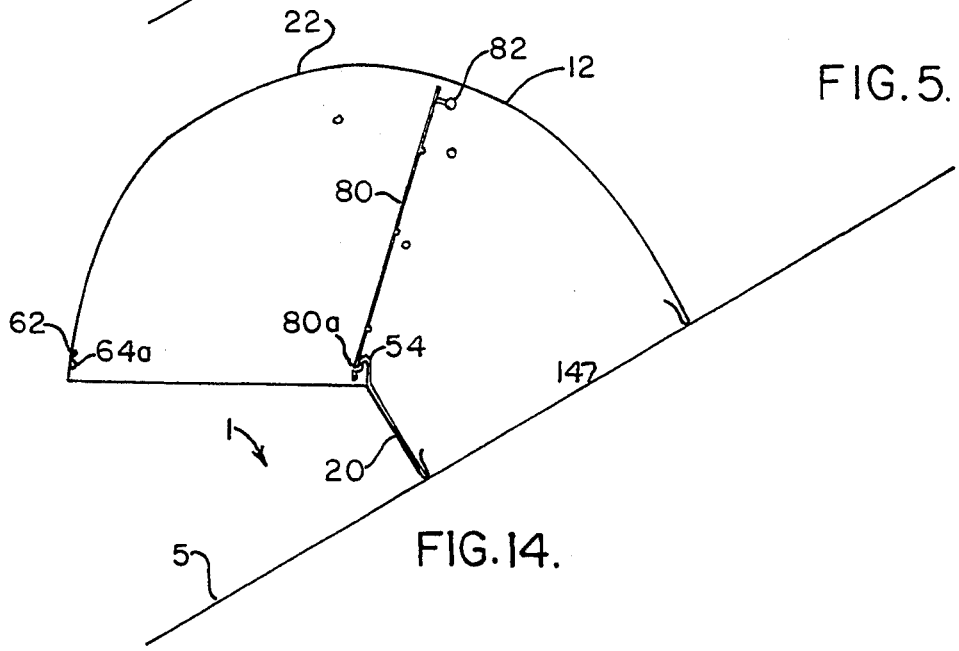
FIG. 14 is a side diagrammatic view showing an alternative wire grid screen as it would be mounted in the same vent housing, if desired.

FIG. 14 shows that the improved vent housing 12 including the novel wire housing stiffener 62 and novel plastic lip 54 can also be used in conjunction with a conventional swingable wire grid 80. In this case, wire grid 80 is positioned in housing 12 to be pivotable about axis rod 82, with the lower edge 80*a* of grid 80 resting against plastic lip 54. The only modification which need be made to housing 12 is the addition of a pair of holes in panels 24 and 26 properly positioned in alignment with axis 82. Again, these holes can be pre-punched at the factory or added in the field. It can therefore be seen that the improved vent housing 12 of the present invention embodies great versatility in accommodating different forms of screens and flap valves other than the novel airfoil flap closures disclosed hereinabove.

It can be seen that the detailed description of the preferred forms of the invention fulfill the objects and advantages set forth above. Inasmuch as numerous modifications may be made to the preferred embodiments without departing from the spirit and scope of the invention, the scope of the invention is to be determined solely by the language of the following claims.

What is claimed is:

1. A roof vent for a grain bin comprising, a housing defining a passageway adapted to communicate air flow between the interior of a grain bin and ambient air;

a flap closure means pivotally mounted within said housing on a horizontal axis above the center of gravity of said flap closure means for substantially blocking solid matter from passing through said passageway when the air pressure differential between the interior of said grain bin and ambient air is insufficient to pivot said flap closure means against the force of gravity acting on said flap closure means;

said flap closure means including a sheet metal flap and a plastic pivot bracket mounted on each lateral side of said flap closure means;

a horizontal rod mounted on said housing extending through said plastic brackets such that said plastic brackets pivot on said rod; and wherein each of said plastic brackets are generally U-shaped having one leg thereof located outward of a respective lateral edge of said flap and having the other leg thereof passing through a respective opening formed in said flap; each of said legs having a horizontal bore through which said rod extends.

2. The roof vent as specified in claim 1 wherein; the midportion of each of said U-shaped brackets extending between said legs being affixed to said flap.

3. The roof vent as specified in claim 1 wherein: said plastic brackets being mounted on said flap closure means a distance from one edge of said closure means equal to between sixty and eighty percent of the height of said closure means.

4. A roof vent for a grain bin comprising:

a housing defining a passageway adapted to communicate air flow between the interior of a grain bin and ambient air;

a first flap closure means pivotally mounted within said housing on a horizontal axis above the center of gravity of said first flap closure means for substantially blocking solid matter from passing through said passageway when the air pressure differential between the interior of said grain bin and ambient air is insufficient to pivot said first flap closure means against the force of gravity and for pivoting and opening at least a portion of said passageway when the air pressure in said bin is sufficiently greater than the ambient air pressure to pivot said first flap closure means against the force of gravity;

a second flap closure means pivotally mounted within said housing on a horizontal axis above the center of gravity of said second flap closure means for substantially blocking solid matter from passing through said passageway when the air pressure differential between the interior of said grain bin and ambient air is insufficient to pivot said second flap closure means against the force of gravity and for pivoting and opening at least a portion of said passageway when the air pressure in said bin is sufficiently less than the ambient air pressure to pivot said second flap closure means against the force of gravity;

both of said first and said second flap closure means is of a curved airfoil shape; and both of said flap closure means being pivotally mounted to said housing along a substantially horizontal axis located from the bottom of respective ones of said flap closure means a distance at least sixty percent of the height and no greater than eighty percent of the height of respective ones of said flap closure means.

* * * * *